US005619759A

United States Patent [19]

Hansen et al.

[11] Patent Number: 5,619,759

[45] Date of Patent: Apr. 15, 1997

[54] INSULATED COVER FOR A HOT TUB

[75] Inventors: Borg Hansen, Long Beach; Rafael Gonzalez, Palmdale, both of Calif.

[73] Assignee: Softub, Inc., Chatsworth, Calif.

[21] Appl. No.: 472,392

[22] Filed: Jun. 7, 1995

[51] Int. Cl.[6] ..... E04H 4/00

[52] U.S. Cl. ..... 4/498; 4/580

[58] Field of Search ..... 4/498, 580, 541.1; 441/40; 482/27, 77

[56] References Cited

U.S. PATENT DOCUMENTS

| | | | |
|---|---|---|---|
| 4,393,528 | 7/1983 | West | 4/498 |
| 4,606,083 | 8/1986 | Kingston | 4/580 |
| 4,857,374 | 8/1989 | Perry | 4/498 |
| 5,092,951 | 3/1992 | Popovich et al. | 156/184 |
| 5,373,590 | 12/1994 | Svae et al. | 4/498 |

*Primary Examiner*—Henry J. Recla
*Assistant Examiner*—Kam R. Shah
*Attorney, Agent, or Firm*—Kelly, Bauersfeld, Lowry & Kelley

[57] ABSTRACT

An improved insulated cover is provided for removable mounting onto a spa or hot tub or the like to minimize thermal and evaporative losses, while additionally safeguarding against foreign objects and/or persons falling into the tub. In the preferred form, the insulated cover comprises an outer frame ring defining a radially outwardly projecting rim, in combination with a structural membrane stretched across the frame ring with a peripheral margin of the membrane wrapped over the outer rim and radially constricted for retention thereon by a drawstring or the like. The frame ring and structural membrane cooperatively define an upwardly open pocket for receiving and supporting a selected insulation material. A flexible decorative top sheet is stretched across the frame ring to close the insulation pocket, wherein a peripheral margin of the decorative top sheet is wrapped over the outer rim and radially constricted for retention thereon by a drawstring or the like.

23 Claims, 4 Drawing Sheets

FIG. 1
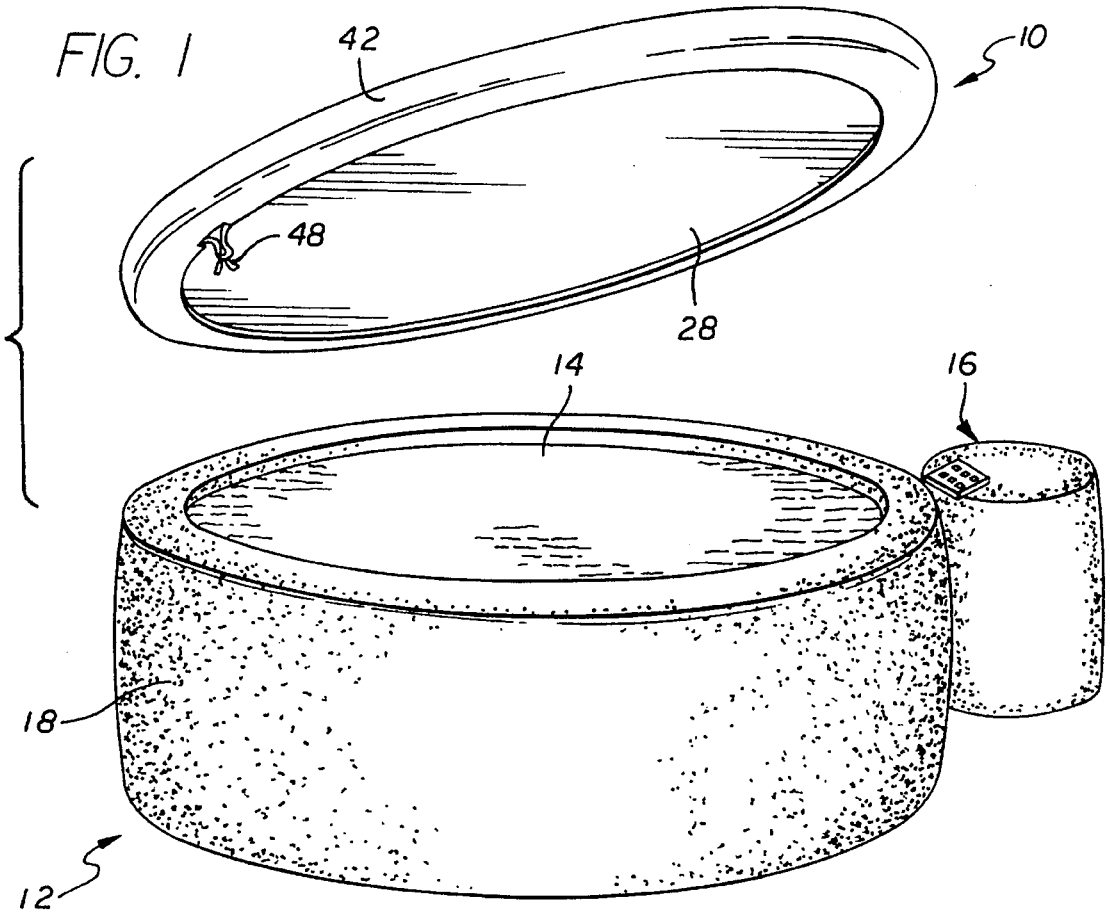
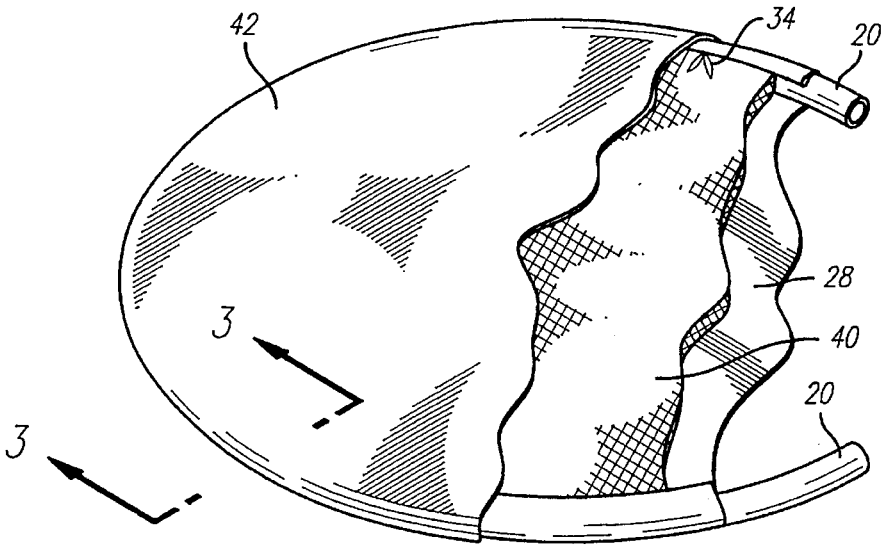
FIG. 2

FIG. 3
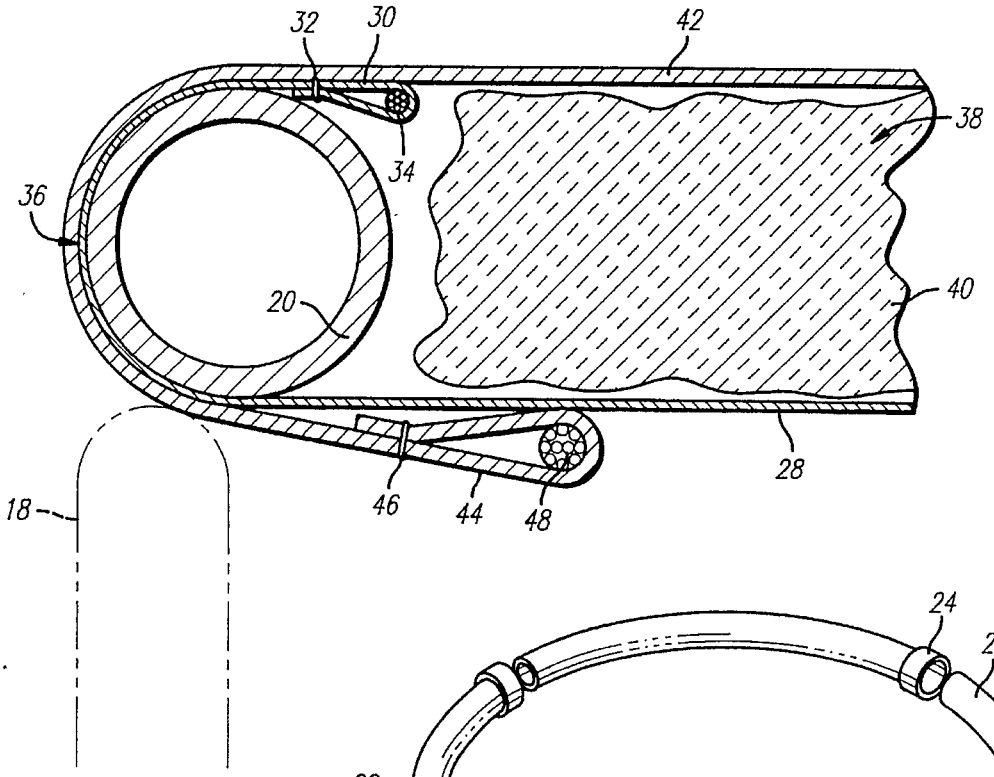
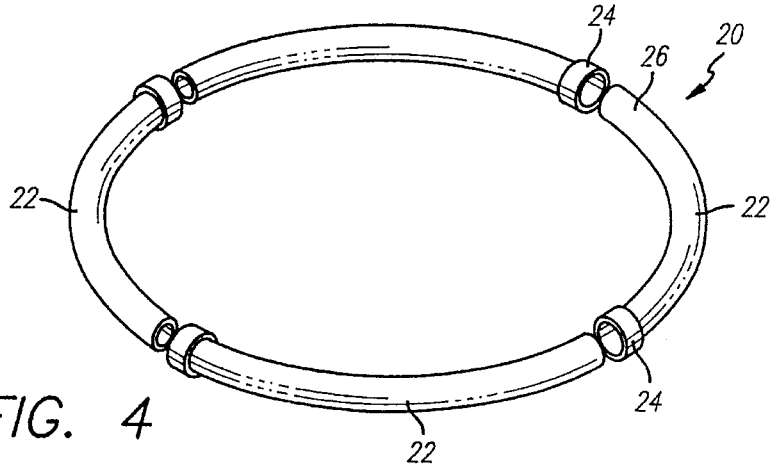
FIG. 4
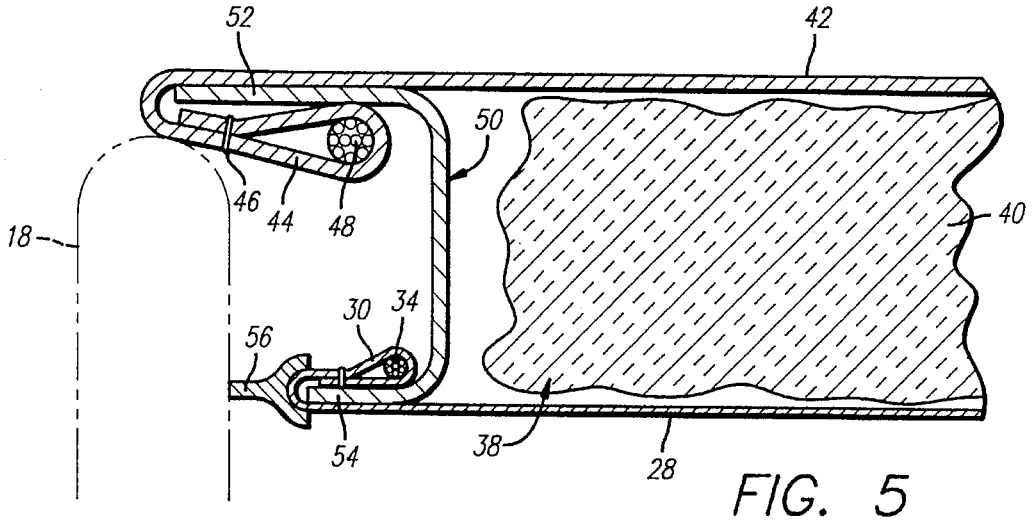
FIG. 5

INSULATED COVER FOR A HOT TUB

BACKGROUND OF THE INVENTION

This invention relates generally to insulated covers or lids for mounting over a tank containing a heated fluid such as water, particularly such as a therapeutic spa tub or hot tub or the like. More specifically, this invention relates to a relatively simple and easily constructed insulated cover designed for minimizing water heat and evaporative losses while additionally safeguarding against foreign objects and/or persons falling into the fluid-containing tank.

Thermal covers for use with swimming pools and spa tubs and the like are generally known in the art. In one common form, such thermal covers comprise a flexible blanket of vinyl or other suitable plastic material to float on the water surface. The flexible blanket is designed to provide an insulative structure which is substantially impermeable to passage of water and air, whereby heat is substantially retained within the body of water and evaporative losses are substantially minimized. Alternative thermal covers which function in an analogous manner include an array of floating objects such as hollow plastic balls which substantially cover the water surface to retain heat and minimize evaporation. However, pool and spa covers of these types provide minimal protection against foreign objects falling into the body of water, particularly with respect to safeguarding against a child or other person falling into the water.

Other protective covers for swimming pools and spa tubs and the like have included relatively high strength blankets of canvas-based or reinforced plastic or vinyl materials, in combination with anchor devices for retaining the blanket in a configuration stretched over the water surface. Such covers beneficially provide protection against persons and foreign objects falling into the body of water, but proper attachment of the cover to the requisite anchor devices represents a time consuming and often difficult task. Moreover, the anchor devices typically require permanent attachment to structural walls or decking surfaces surrounding the pool or spa tub. Furthermore, anchored safety covers of this general type often provide minimal prevention of heat and evaporative water losses.

The present invention represents a significant improvement in insulative covers for a fluid-containing tank, particularly such as a spa or hot tub or the like, wherein the insulative cover is adapted for quick and easy installation to protect against significant heat and evaporative losses, while additionally presenting a high strength structure to safeguard against persons and other foreign objects falling into the tank.

SUMMARY OF THE INVENTION

In accordance with the invention, an improved insulated cover is provided for removable mounting onto a fluid-containing tank such as a spa tub or hot tub or the like. The insulative cover has a relatively simple and lightweight construction adapted for easy assembly and installation to extend over and cover a body or water or the like. In use, the insulated cover provides effective protection against thermal and evaporative losses, in addition to effective protection against persons or other foreign objects falling into the water.

In the preferred form, the insulative cover comprises an outer frame ring which may have a unitary one-piece construction but is preferably formed by a plurality of assembled frame segments. The outer frame ring defines a radially outwardly projecting outer rim. A structural membrane of relatively high tensile strength material which is impervious water and air passage is stretched across the frame ring with a peripheral margin of the membrane being wrapped over the outer rim and radially constricted for retention thereon by means of a drawstring or the like. The thus-assembled frame ring and structural membrane cooperatively define an upwardly open pocket for receiving and supporting a selected insulation material. The insulation pocket is then closed by a decorative top sheet which is stretched across the frame ring with a peripheral margin thereof wrapped over the outer rim and radially constricted for retention thereon by means of a drawstring or the like.

In user the insulated cover has a size and shape for substantially covering the body of water. In the preferred form, the outer frame ring is vertically supported on an outer wall of the tub or tank. A portion of the frame ring can be configured to extend downwardly into the body of water, thereby defining a substantially closed chamber between the water surface and the underside of the insulated cover for further prevention of heat and evaporative losses. A peripheral seal may also be incorporated into the outer frame ring, for engaging the wall of the tub or tank, to further reduce heat and evaporative losses. In one alternative form, the insulation pocket can be associated with an air valve to permit inflation thereof, with the result that the cover can be tailored in shape to fit snugly into the tub or tank in a position floating on the surface of the water if desired.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is an exploded perspective view illustrating a therapeutic spa or hot tub in association with an improved insulated cover embodying the novel features of the invention;

FIG. 2 is a top perspective view illustrating the insulated cover of FIG. 1, with portions broken away to depict internal construction details thereof;

FIG. 3 is an enlarged fragmented vertical sectional view taken generally on the line 3—3 of FIG. 2;

FIG. 4 is an exploded perspective view illustrating an outer frame ring, in one preferred form, for use in the insulative cover of the present invention;

FIG. 5 is an enlarged fragmented sectional view similar to FIG. 3, and illustrating one alternative preferred form of the invention;

DETAILED DESCRIPTION OF THE PREFERRED EMBODIMENTS

Figure 6:
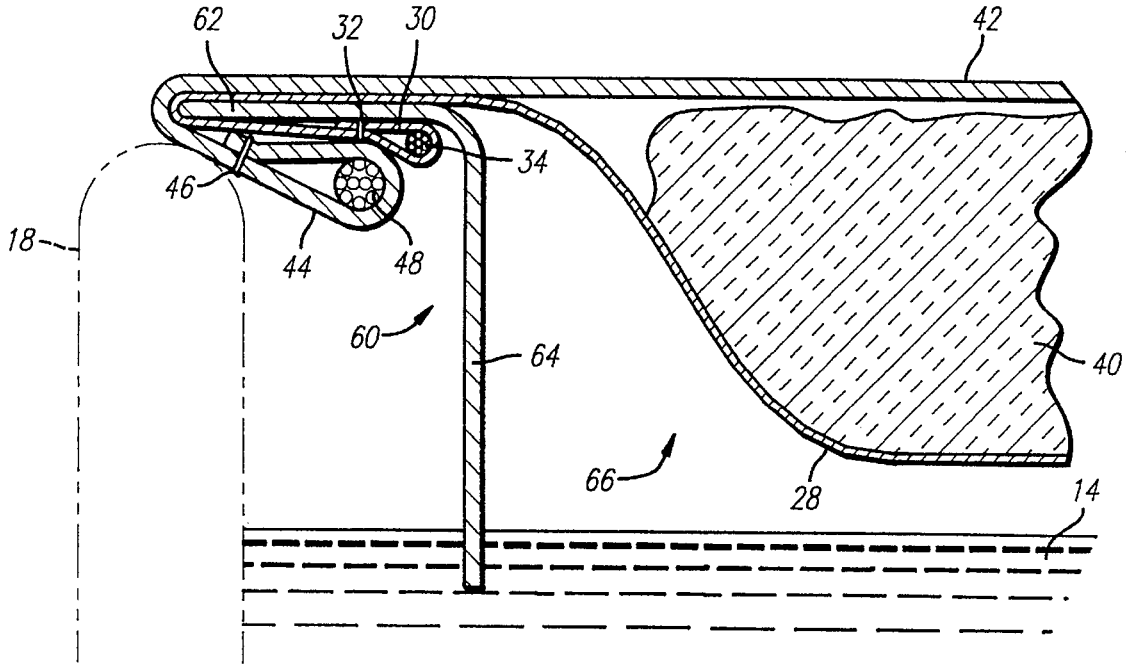
FIG. 6 is a fragmented vertical sectional view similar to FIGS. 3 and 5, and depicting a further alternative preferred form of the invention.

As shown in the exemplary drawings, an improved insulated cover referred to generally in FIG. 1 by the reference numeral 10 is provided for use with a fluid-containing tank 12 such as a therapeutic spa tub or hot tub or the like. The insulative cover 10 is designed to prevent substantial heat loss and evaporative loss from a body of water 14 contained within the tank 12. In addition, the insulated cover 10 protects against foreign objects falling into the water 14, particularly such as safeguarding against children or other persons failing into the water.

The spa tub 12 shown in FIG. 1 has a conventional construction and operation to include a control module 16 containing an appropriate pump and heater (not shown) for circulating and heating the water 14 typically in the form of therapeutic jets. In this regard, the spa tub 12 and the related control module 16 may be constructed in accordance with commonly assigned U.S. Pat. No. 5,092,951, which is incorporated by reference herein. Importantly, the spa tub 12 defines an upwardly open enclosure, including an upstanding and preferably insulated peripheral side wall 18, for receiving and retaining the water 14.

The insulated cover 10 of the present invention is adapted for removable mounting onto the spa tub 12 when said tub is not in use. The cover 10 provides an insulative structure which is substantially impervious to passage of water and air, whereby heat losses and evaporative losses from the water 14 are substantially prevented during a period of non-use in addition, the insulated cover 10 comprises a relatively lightweight and easily assembled structure having sufficient strength to safeguard against foreign objects falling into the water 14, particularly such as children and other persons.

FIGS. 1–3 illustrate the insulated cover 10 in one preferred form. More specifically, the cover 10 comprises a relatively lightweight outer frame ring 20 which can be constructed from tubular plastic material such as PVC tubing or the like. FIG. 4 shows a preferred frame ring construction to include an assembled plurality of telescopically interfitted tubular frame segments 22. These frame segments 22 each have an arcuate part-circular shape to include an enlarged collar 24 at one end for slide-fit reception of a narrower opposite end 26 of an adjacent frame segment 22. Construction of the frame ring 20 from such multiple segments beneficially permits the unassembled components of the cover 10 to be shipped in a compact package. The illustrative drawings show the preferred frame ring 20 to have a generally circular shape, although it will be understood that other alternative closed loop geometric configurations may be used in accordance with the configuration of the associated spa tub 12.

The outer frame ring 20, as described above, is assembled with a structural membrane 28 of a selected material which is substantially impermeable to water and air passage. The structural membrane 28 has a general geometric shape conforming to the configuration of frame ring 20, with an outer peripheral margin 30 folded back upon itself to define a closed loop formed by a seam 32 (FIG. 3), with a drawstring 34 or the like threaded through the closed loop. The structural membrane 28 is stretched across the frame ring 20, to extend across an underside surface thereof, and the peripheral margin 30 is wrapped upwardly about the frame ring 20 to extend radially inwardly a short distance at the top of the frame ring. In this regard, the radial outermost extent of the frame ring 20 inherently defines a radially outwardly protruding rim 36 (FIG. 3) about which the periphery margin 30 of the structural membrane 28 is wrapped. The drawstring 34 is then drawn tightly through the seam 32 and appropriately tied or secured to radially constrict the membrane outer margin 30 to a diametric size smaller than the frame ring 20. With this construction, the membrane 28 is securely attached to the frame ring 20.

in the preferred form, the structural membrane 28 comprises a relatively high tensile strength flexible material capable of vertically supporting anticipated loads to be applied to the insulated cover 10 during normal use. While the specific membrane material can vary, a fiber-based or fiber reinforced material which has been impregnated, or laminated with a flexible plastic such as flexible PVC or urethane is preferred. As shown best in FIGS. 2 and 3, the outer frame ring 20 and the structural membrane 28 cooperatively define an upwardly open pocket 38 for receiving and supporting a selected insulation material 40. One preferred insulation material comprises a sheet or blanket of fibrous insulation batting material. Alternatively, lightweight insulative sheets of expanded foam such as polystyrene may also be used. Still further, if desired, the insulation material 40 may comprise a supply of loose insulative beads or other particulate.

The insulation pocket 38 is then closed by a decorative top sheet 42. This decorative top sheet also comprises a sheet of selected and typically weather-proof plastic coated material or the like such as a marine grade vinyl-based material having a general configuration similar to the shape of the frame ring 20. An outer peripheral margin 44 of the top sheet 42 is folded back upon itself and is seamed at 46 to define a closed loop through which another drawstring 48 or the like is received. The decorative top sheet 42 is stretched over the top of the frame ring 20, thereby closing the insulation pocket 38, with the periphery wrapped downwardly over the rim 36 to extend radially inwardly a short distance beneath the frame ring 20. The drawstring 48 is then drawn tight and tied to retain the peripheral margin 44 of the top sheet 42 in a radially constricted position with a diametric size smaller than the frame ring 20.

The thus-assembled insulative cover 10 can be installed quickly and easily onto the spa tub 12, by placing the cover 10 in a position with the frame ring 20 rested upon an upper edge of the tub side wall 18. In this position, the cover 10 effectively minimizes heat loss and evaporative losses from the body of water 14 within the tub 12. In addition, vertical loads applied to the cover 10 are effectively supported by the cover structure, particularly the structural membrane 28 which transmits such loads intention to the frame ring 20 to support such loads in compression.

FIG. 5 shows one alternative preferred form of the invention wherein a modified frame ring 50 is shown with a generally U-shaped and outwardly open channel configuration to define upper and lower outwardly projecting rims 52 and 54, respectively. The lower rim 52 is adapted for wrap-over mounting of the peripheral margin 30 of the structural membrane 28, generally in the same manner as described with respect to FIGS. 1–3. The upper rim 52 is adapted for wrap-over mounting of the peripheral margin 44 of the decorative top sheet 42, again as previously described with respect to FIGS. 1–3. However, FIG. 5 shows The upper rim 52 projecting radially outwardly for a distance greater than the lower rim 54, whereby the upper rim 52 is adapted to rest upon the top of the tub side wall 18. By contrast, the lower rim 54 is sized for slide-fit reception into the tub interior. A wiper seal 56 of a suitable elastomer may be installed to extend circumferentially about the lower rim 54 for sealing engagement with an inner diameter surface of the tub side wall 18, for improved prevention of evaporation losses.

FIG. 6 shows another alternative configuration for a modified frame ring 60, wherein the frame ring 60 has an inverted, generally L-shaped cross section to define a radially outwardly projecting rim 62 and a downwardly extending circumferential seal leg 64. In this embodiment, as viewed in FIG. 6, the peripheral margins 30 and 44 of the structural membrane 28 and decorative top sheet 42 are both wrapped over and secured by the respective drawstrings to the rim 62. The rim 62 has an overall size and shape to rest upon the top of the tub side wall 18. When installed in this position, the seal leg 64 of the frame ring 60 projects downwardly for reception a short distance into the body of water 14, whereby the seal leg 64 cooperates with the structural membrane 28 to define a sealed insulation chamber 66 beneath the insulated cover. This sealed chamber 66 further enhances the insulation characteristics of the cover, while additionally preventing undesired evaporative water losses.

Figure 7:
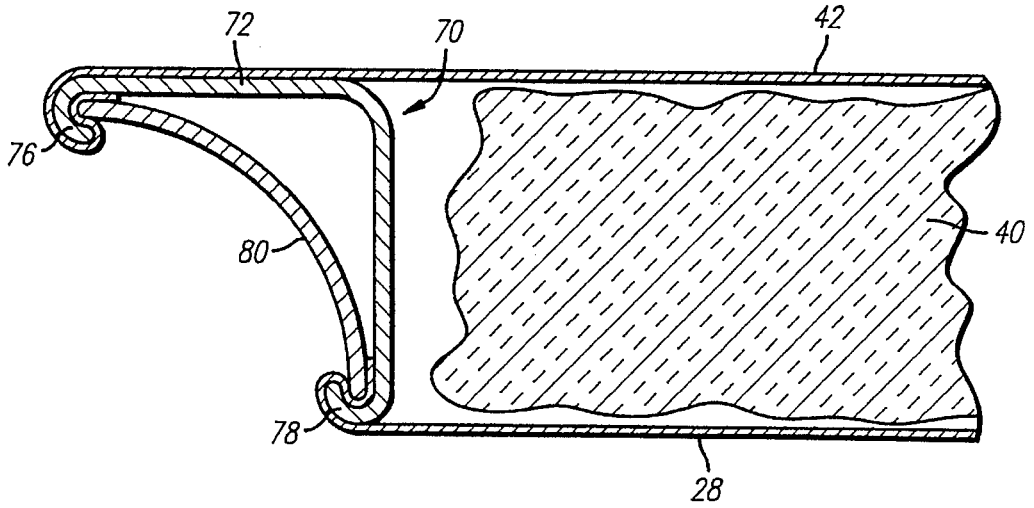
FIG. 7 is an enlarged fragmented vertical sectional view similar to FIGS. 3, 5 and 6, but depicting still another alternative preferred form of the invention.

A further modified frame ring geometry is shown in FIG. 7, wherein a frame ring 70 has a generally inverted L-shaped cross section to define a radially outwardly projecting rim 72 and a downwardly projecting leg 74. In this embodiment, the rim 72 and leg 74 each include an inturned lip 76 and 78, respectively, at the distal or free ends thereof. The structural membrane 28 and the decorative top sheet 42 have their peripheral margins respectively wrapped over the leg 74 and rim 72, to extend within the associated lips 76 and 78. A spring-loaded retainer plate 80 is then fitted into the frame ring 70, with opposite ends thereof springably seated within the lips 76, 78 to retain the margins of the structural membrane 28 and decorative top sheet 42 within the associated lip cavities. Accordingly, the frame ring configuration of FIG. 7 permits secure mounting of the structural membrane 28 and decorative top sheet 42 to the frame ring, with alternative mounting means in lieu of the closed loop seams and drawstrings as previously described.

Figure 8:
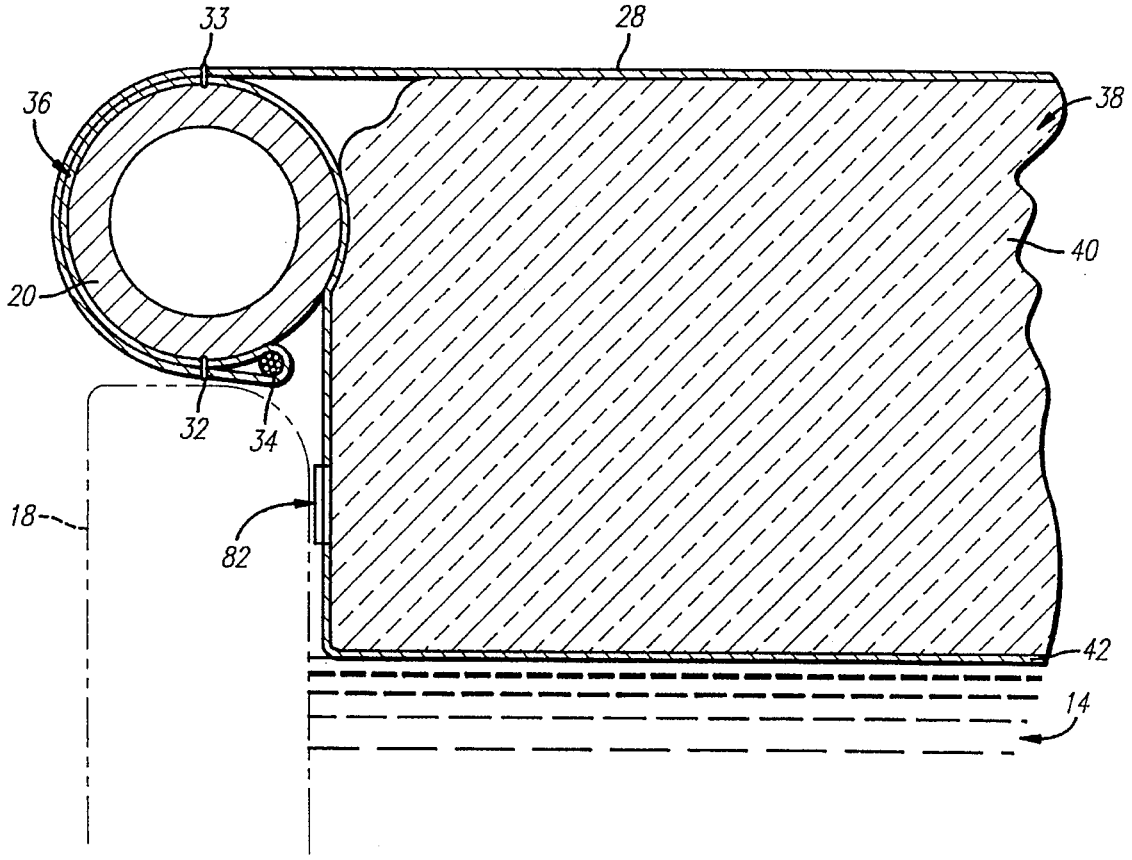
FIG. 8 Is another enlarged fragmented vertical sectional view similar to FIGS. 3 and 5–7, but showing another preferred embodiment of the invention.

In FIG. 8, another preferred form of the invention is shown, wherein a frame ring 20 of the type previously described (FIGS. 1–4) is provided for seated support onto the top of the side wall 18 of the tub or tank. In this version, the structural membrane 28 is shown stretched across the top of the frame ring 20, with a periphery of the membrane 28 wrapped downwardly over the outer rim 36 of the frame ring. The membrane periphery is wrapped back on itself and seamed, as at 32, to define a closed loop to receive a drawstring 34 used as previously described to radially constrict the loop and thereby mount the membrane 28 onto the frame ring.

In the embodiment of FIG. 8, the structural membrane 28 is shown joined integrally to the second sheet 42, which in this case is disposed at the bottom of the insulation pocket 38 and cooperates with the frame ring 20 and top membrane 28 to retain insulation material 40. This second sheet 42 thus extends from the seam 32 back over the rim 36 and then downwardly within the frame ring 20. A second seam 33 is desirably provided at the top of the frame ring 20 to prevent entrapment of insulation material between the portions of the sheets 28, 42 to be wrapped over the frame ring.

The second lower sheet 42 is suspended somewhat loosely within the frame ring 20 to project downwardly therefrom. As air valve 82 is mounted on the sheet 42 to permit inflation of the insulation pocket 38, whereby the size and shape of a central portion of the cover can be inflation-tailored to fit snugly into the tub with a pressure-fit against the inboard side of the tub side wall 18. Moreover, the central portion of the cover can be sized and shaped to float directly on the water 14, so that the water provides additional structural support for the cover. The combination of the frame ring 20 and the suspended central portion of the cover cooperate to securely locate and retain the cover of the tub. In this embodiment, to accommodate inflation as described, the structural membrane 20 and the second sheet 42 are both constructed from a material impervious to air passage.

A variety of further modifications and improvements to the insulated cover 10 of the present invention will be apparent to those skilled in the art. Accordingly, no limitation on the invention is intended by way of the foregoing description and accompanying drawings, except as set forth in the appended claims.

What is claimed is:

1. An insulated cover for removable mounting onto a fluid-containing tank, said insulated cover comprising:

an outer frame ring formed in a closed loop configuration and defining at least one outwardly projecting rim;

a structural membrane having a periphery connected to said frame ring and cooperating therewith to define an upwardly open insulation pocket, said structural membrane having the periphery thereof wrapped over said rim;

insulation means received into said insulation pocket; and a top sheet having a periphery connected to said frame ring to close said insulation pocket with said insulation means therein.

2. The insulated cover of claim 1 wherein said structural membrane comprises a flexible material substantially impervious to passage of air and water.

3. The insulated cover of claim 2 wherein said top sheet comprises a flexible material substantially impervious to passage of air and water.

4. The insulated cover of claim 3 further including valve means for permitting inflation of said insulation pocket.

5. The insulated cover of claim 1 wherein said top sheet comprises a flexible material substantially impervious to passage of air and water.

6. The insulated cover of claim 1 wherein said frame ring is formed from plastic tubing.

7. The insulated cover of claim 1 wherein said frame ring comprises a plurality of tubing segments connected end to end to form a closed loop configuration.

8. The insulated cover of claim 1 wherein said frame ring has a circular configuration.

9. The insulated cover of claim 1 wherein said top sheet has the periphery thereof wrapped over said rim.

10. The insulated cover of claim 1 wherein said structural membrane has a seamed peripheral margin with a drawstring received therethrough for radially constricting said peripheral margin to retain said structural membrane on said frame ring.

11. The insulated cover of claim 10 wherein said top sheet has a seamed peripheral margin with a drawstring received therethrough, the periphery of said top sheet being wrapped over said rim and said top sheet drawstring being for radially constricting said top sheet peripheral margin to retain said top sheet on said frame ring.

12. The insulated cover of claim 1 wherein said frame ring further includes a downwardly extending peripheral leg having a lower end for reception into a fluid within the tank when said cover is mounted on the tank.

13. The insulated cover of claim 1 further including a peripheral seal member carried by said frame ring for engaging the tank when said cover is mounted on the tank.

14. An insulated cover for removably mounting onto a spa tub having an upstanding peripheral side wall, said insulated cover comprising;

an outer frame ring formed in a closed loop configuration and defining at least one outwardly projecting rim;

a structural membrane formed from a flexible material substantially impermeable to passage of air and water, said structural membrane being stretched across said frame ring with a periphery of said structural membrane wrapped over said rim;

first means for securing said structural membrane to said frame ring, whereby said structural membrane cooperates with said frame ring to define an open insulation pocket;

insulation means received into said insulation pocket;

a second sheet of flexible material stretched across said frame ring with a periphery of said second sheet wrapped over said rim; and second means for securing said second sheet to said frame ring to close said insulation pocket.

15. The insulated cover of claim 14 wherein said frame ring has a size and shape to rest on top of the side wall of said spa tub.

16. The insulated cover of claim 15 further including valve means to permit inflation of said insulation pocket.

17. The insulated cover of claim 15 wherein a portion of said cover circumscribed by said frame ring has a size and shape to rest on water contained within the spa tub.

18. The insulated cover of claim 14 wherein said frame ring includes a peripheral seal member for engaging and sealing with an inner surface of said side wall when said cover is mounted on the spa tub.

19. The insulated cover of claim 14 wherein said frame ring further includes a downwardly extending peripheral leg having a lower end for reception into water within the spa tub when said cover is mounted on the spa tub.

20. The insulated cover of claim 14 wherein said first means comprises a seamed peripheral margin on said structural membrane and a drawstring received therethrough for radially constricting said peripheral margin to retain said structural membrane on said frame ring.

21. The insulated cover of claim 20 wherein said second means comprises a seamed peripheral margin on said second sheet and a drawstring received therethrough for radially constricting said second sheet peripheral margin to retain said second sheet on said frame ring.

22. The insulated cover of claim 14 wherein said frame ring comprises a plurality of tubing segments connected end to end to form a closed loop configuration.

23. The insulated cover of claim 14 wherein said second sheet comprises a flexible material substantially impervious to passage of air and water.

* * * * *